United States Patent [19]

Cantelon

[11] 4,201,388

[45] May 6, 1980

[54] GAME APPARATUS

[76] Inventor: Ruth F. Cantelon, 2804 Vallette St., Bellingham, Wash. 98225

[21] Appl. No.: 832,116

[22] Filed: Sep. 12, 1977

[51] Int. Cl.[2] ..... A63F 3/00

[52] U.S. Cl. ..... 273/251; 273/288

[58] Field of Search ..... 273/243, 249, 248, 250–252, 273/272, 299–302; 35/9 R, 23 R

[56] References Cited

U.S. PATENT DOCUMENTS

| | | | |
|---|---|---|---|
| 1,224,173 | 5/1917 | Kajiyama | 273/249 |
| 1,352,510 | 9/1920 | Gibson | 273/243 |
| 1,391,333 | 9/1921 | McManus | 273/249 |
| 1,525,417 | 2/1925 | Steinberg | 273/243 |
| 1,552,254 | 9/1925 | White | 273/249 |
| 1,635,734 | 7/1927 | Ziegler | 35/9 R |
| 1,714,546 | 5/1929 | Caldon | 273/257 |
| 3,143,348 | 8/1964 | Carsen | 273/302 |
| 3,215,435 | 11/1965 | Rheingruber | 273/249 |
| 3,533,628 | 10/1970 | Fisher | 273/250 |
| 3,704,018 | 11/1972 | Fyanes | 273/243 |
| 3,829,098 | 8/1974 | Umminger, Jr. | 273/249 |
| 3,831,946 | 8/1974 | Denalsky | 273/249 |
| 3,850,433 | 11/1974 | Purlia | 273/256 |
| 3,942,800 | 3/1976 | Holbrook | 273/243 |
| 3,945,643 | 3/1976 | Breslow | 273/243 |
| 3,947,038 | 3/1976 | Archer | 273/254 |
| 4,079,941 | 3/1978 | Morales | 273/290 |

FOREIGN PATENT DOCUMENTS

| | | | |
|---|---|---|---|
| 270152 | 5/1927 | United Kingdom | 273/251 |
| 801964 | 1958 | United Kingdom | 273/243 |
| 1187095 | 4/1970 | United Kingdom | 273/243 |

*Primary Examiner*—Richard C. Pinkham
*Assistant Examiner*—R. Carl Moy

[57] ABSTRACT

A game based upon the religious novel *Pilgrim's Progress* in which spiritual and moral values are an integral part thereof. A game board is divided into two sections of play and displays a path of travel, as in *Pilgrim's Progress,* along which the participants each move a marker, with progress along the path being determined by the turn of a spinner/compass, having two levels governing play over the two sections of the display path, or by a pair of dice, governing the direction and duration of diversions from the main path. There are corresponding sets of question and answer cards, with the question cards containing a biblical quotation with key words deleted therefrom and possible answer words provided therebelow, and with the answer cards indicating the correct words to be filled into the quotation. Winners are determined in two ways. One winner is the one whose marker first reaches the end point after traversing the entire path. A second winner is the one having the greatest number of points from play with the question and answer cards.

14 Claims, 12 Drawing Figures

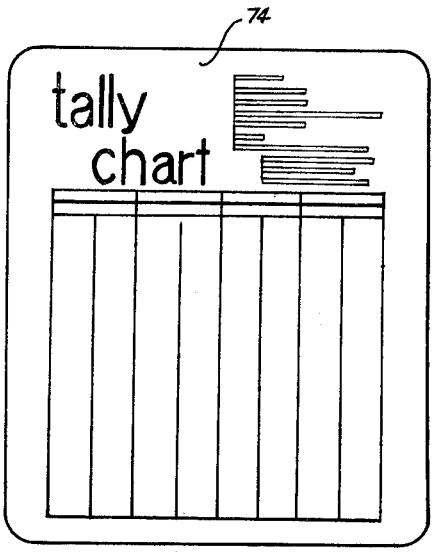
Fig. 4.
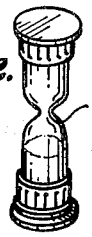
Fig. 2.
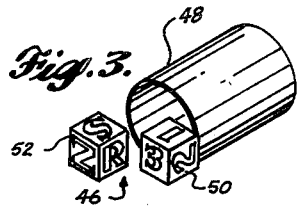
Fig. 3.
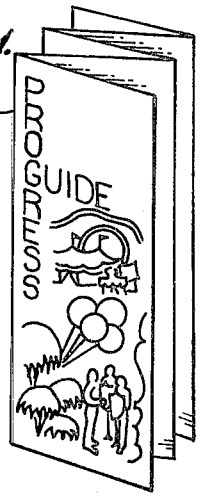
Fig. 11.
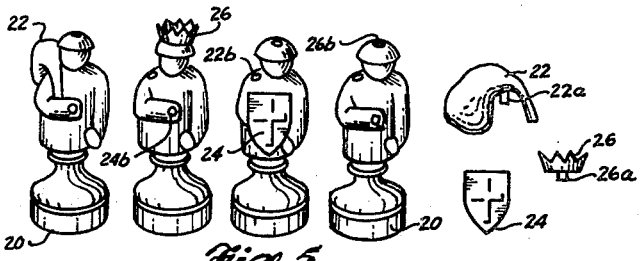
Fig. 5.
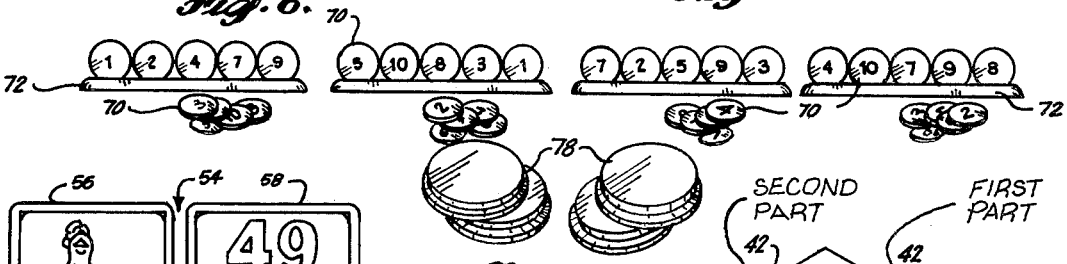
Fig. 6.
Fig. 7.
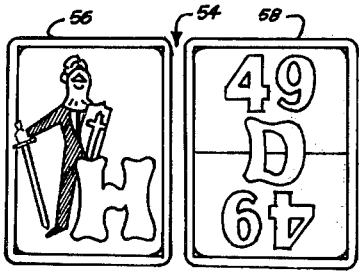
Fig. 9.
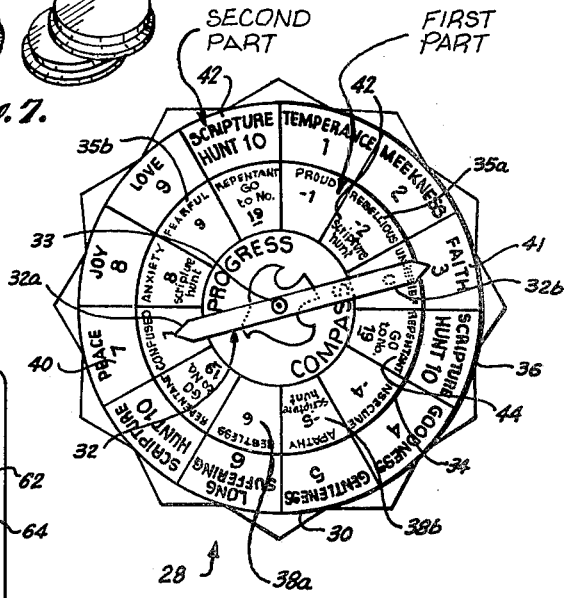
Fig. 8.
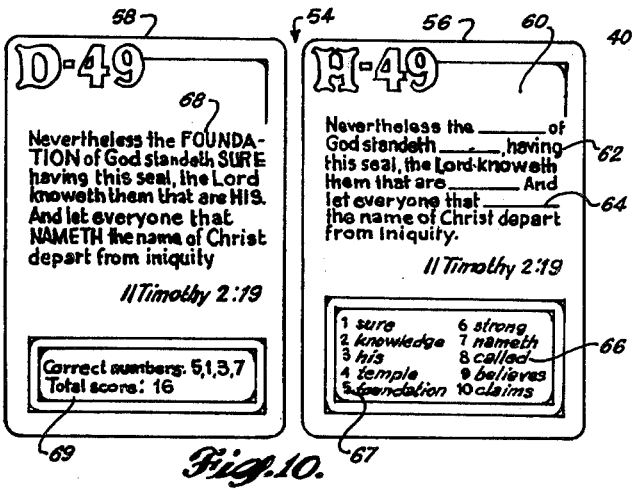
Fig. 10.

GAME APPARATUS

BACKGROUND OF THE INVENTION

1. Field of the Invention

The present invention relates to an educational game which relates moral values to progress in the game, and more particularly to a game in which the success of each participant is determined partly by his knowledge of biblical scripture and partly by chance.

2. Brief Description of the Prior Art

Games requiring the participants to correctly answer questions in order to proceed have occured a number of times in the prior art. In some instances these games are for amusement purposes only, while others have an educational motive, either secular or religious. In such games, a problem or question is posed to the contestant or participant, and to proceed further in the game a correct answer must be provided. Also, there are games which relate progress in the game to moral values or events in human life.

Certain games of this type have appeared in the patent literature. For example, U.S. Pat. No. 1,224,178, Kajiyama, shows a game in which players progress through a series of life-simulating conditions, namely wealth, poverty, knowledge, travel, work, etc., by the roll of a die or by a spinner. U.S. Pat. No. 1,391,333, McManus, shows multiple paths over which the players may proceed depending upon the roll of a die, one such path being a short-cut to the finishing point.

U.S. Pat. No. 3,831,946, Denalsky, shows a question and answer game in which the player is presented with a question card with the answer hidden thereon and which must be correctly answered before proceeding. Upon correctly answering the question presented, the contestant is allowed another throw of the die or spin of the spinner. U.S. Pat. No. 3,942,800, Holbrook, shows an archeological game in which the cards provided may be genuine or false clues to the correct resolution of the puzzle. While not using question and answer cards, U.S. Pat. No. 3,945,643, Breslow, shows a game in which points are scored by the correct resolution of riddles provided on game pieces.

Other examples of the prior art are shown in the following patents: U.S. Pat. No. 1,352,510, Gibson; U.S. Pat. No. 3,215,435, Rheingruber; U.S. Pat. No. 3,704,018, Fyanes. While these games are not particularly relevant to the type of play in the present invention, they are representative of various game board configurations and game components used in conjunction therewith.

It is an object of the present invention to provide an educational game in which the contestants will become familiar with Bible scripture and teachings, and the religious allegory *Pilgrim's Progress,* with the game being arranged such that the participants progress through the game to simulate a reenactment of the main character in *Pilgrim's Progress* passing through life.

SUMMARY OF THE INVENTION

There is a game board having a representation of a course of progress, such as a path, leading from a beginning point to an end point and divided into increments of travel, such as squares, along which progress indicators, such as markers, can be moved to indicate the progress of a player. In the preferred form, the game is constructed so as to correlate with the path of life traveled by the Pilgrim in the religious novel *Pilgrim's Progress.*

The object of the game is to familiarize the participants with the biblical scripture and teachings relevant to the progression of Pilgrim from Destruction City to Celestial City. The object is accomplished by having each participant reenact the journey as a Pilgrim along the game board path, experiencing the same obstacles and challenges as encountered in *Pilgrim's Progress.*

There are markers in the form of a pilgrim, provided each participant, and detachable members for attachment thereto. A detachable member in the form of a burden is attached to the marker at the beginning point and removed at the end of the first section of said path. A detachable member in the form of a shield is attached to the marker at the beginning of the second section of said path.

The game board display path is divided into individual squares, each with a phrase relevant to an analogous event in *Pilgrim's Progress* and a biblical notation relevant to the same event. Some of the squares merely indicate progress along the course, while other of the squares in addition require the participant to perform further tasks in order to complete a turn.

The game board may have points of diversion, denoted junction squares, requiring a participant to move his marker off the main path and onto a side path, symbolizing the diversions experienced by Pilgrim on his journey. Reentry onto the main path for continued progression is afforded on the participant's subsequent turn.

The game board path is divided into two sections, a first section of the path corresponding to the first portion of the Pilgrim's journey in a spiritually unenlightened condition, and a second section of the path corresponding to the latter part of Pilgrim's journey after becoming Christian, said portion being travel in a more enlightened condition.

There is a first chance means in the form of a spinner/compass used in conjunction with play upon the game board. There are two levels of play, an inner level of play governing progress over the first portion of the path and an outer level governing progress over the second portion of said path. The inner less desirable level of the spinner/compass is characterized by adjacent numerical designations of both positive and negative value, indicating that travel over the first portion of said path may be either progressive or regressive. There are character traits associated with each of the numerical designations corresponding to the unenlightened level of play on the first level, such as apathy, anxiety, and unbelief. The outer level of the spinner/compass is characterized by adjacent numerical designations of positive value only, indicating travel over the second portion in a more spiritually enlightened condition, as evidenced by the associate character traits such as love, faith and peace.

There is a second chance means which in the preferred form is a pair of dice, to be utilized when a participant's marker comes to rest upon a junction square and is required to be diverted from the main path. One of the dice is used to determine the direction of the diversion and the other to determine the length of said diversion.

Question and answer indicating means are provided as a feature of the game apart from the game board progression, but utilized simultaneously. Question cards containing a biblical quotation of relevance to *Pilgrim's Progress* with key words deleted therefrom are provided, and participants attempt to choose the correct missing key word from a list of numbered possible correct answer words provided therebelow. After displaying which key words the participant has chosen by means of numbered tokens and checking correct answers on an answer card provided, the participant is awarded points for each correct answer chosen based upon the numerical designation of said correct answer word. The player with the greatest number of points at game's end is a winner independent of play on the game board.

A Bible, such as the King James Version, is an additional component to be supplied by the participants for use with scripture hunts which may be required during play of the game.

In playing the game, each participant in turn progresses along the course of the game board path by traveling the number of squares indicated by a spin of the spinner/compass, play over the first portion of said path being governed by play on the inner level of said spinner/compass, and play over the second portion of said path being governed by play on the outer level of said spinner/compass. Additional play may be required by instructions provided for each square upon which a player's marker may come to rest. Concurrently, the player attempts to supply correct answers for deleted key words in biblical phrases presented on question cards from a plurality of possible correct answer words presented therebelow. Answer cards are thereafter utilized to reveal the correct answer words. Points are awarded for each correct answer supplied by the participant based on the numerical designation of said correct answer word. The game is ended when one participant successfully moves his marker from the beginning point to the end point, there being two possible winners at that time, namely that player first reaching the end point and that player with the most points from correctly supplying answers to question cards.

It is suggested that participants have previously read *Pilgrim's Progress* in order to more fully appreciate the game and its significance.

Other features of the present invention will become apparent from the following detailed description.

BRIEF DESCRIPTION OF THE DRAWINGS

FIG. 2 shows a timer to determine the length of each participant's turn;

FIG. 3 shows a pair of dice by which a participant's diversion from the main path is determined;

FIG. 4 shows a tally chart for recording a participant's scripture points;

FIG. 5 shows a marker with burden, shield and crown attachments;

FIG. 6 shows numbered tokens and holders therefor;

FIG. 7 shows a card holder;

FIG. 8 shows a spinner/compass by which a participant's progress along the game board is determined;

FIG. 9 shows the back side of the question (Hearer) and answer (Doer) cards; and FIG. 10 shows the playing side of the question (Hearer) and answer (Doer) cards with a typical scripture notation leading to the award of scripture points.

FIG. 11 shows an instruction booklet included in the game apparatus.

DESCRIPTION OF THE PREFERRED EMBODIMENT

The underlying basis for the present invention is the classic religious allegory *Pilgrim's Progress.* The invention is intended to provide the players with a reenactment or simulation of the more important events in the novel upon which it is based. It is believed that a better understanding of the game, its game board and its significance may be gained by preceding the description of the game with a general description of *Pilgrim's Progress.*

The author of *Pilgrim's Progress,* Englishman John Bunyan, was a "carefree and reckless" man until he became a Christian. He eventually became a popular Protestant preacher, and was sent to prison for refusing to conform his religious views with those of the national religion, The Church of England. While in prison, Bunyan wrote *Pilgrim's Progress,* an allegory showing a confused and burdened man embarking on a journey, then becoming a Christian and after many trials and tribulations eventually arriving in "Celestial City". The journey involved both positive and negative experiences of temporal and permanent nature, decisions and crisis. In facing these and other situations, the Pilgrim's travel "equipment" is a choice between self-centered independence or God-controlled direction.

In the novel, Pilgrim leaves Destruction City, and eventually becomes "Christian". In spite of new-found joy and spiritual commitment, Pilgrim finds the path has many detours and diversions challenging his faith. Unharnessed desires, deceptive advice and quick decisions steer him off course, but the important lesson to be learned is to be resolute in one's faith and not despair of reaching the "Celestial City".

The first part of the journey is evidenced by a fearful, misguided and deceived Pilgrim, who finally overcomes his burden of unenlightenment and becomes a Christian. At that point he becomes filled with joy and peace, but is still beset by diversions. Having successfully endured these trials he gains the spiritual armor necessary to complete the remainder of his journey. He thus proceeds with the spiritual commitment and protection necessary to overcome whatever hardships lie before him on his journey to "Celestial City". After finally reaching "Celestial City" he discards his armor and is received into his final destination.

It is recommended that the participants in the game be familiar with *Pilgrim's Progress* in order to enrich the literary experience provided through playing the game. With the forgoing information in mind, the main components of the present invention will now be described.

THE GAME BOARD

Figure 1A:
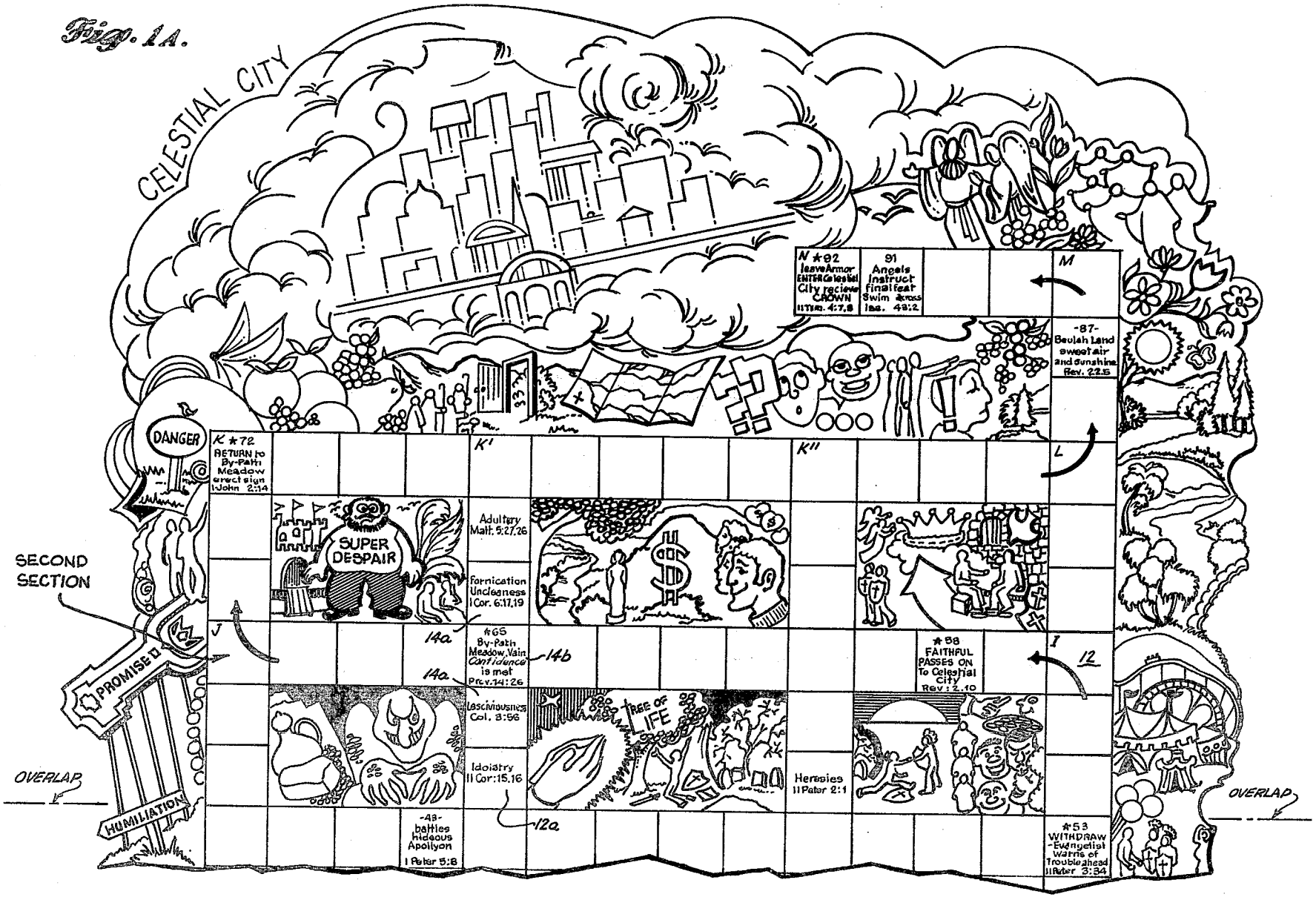
FIGS. 1A & 1B together are a perspective view of the game board of the present invention.
Figure 1B:
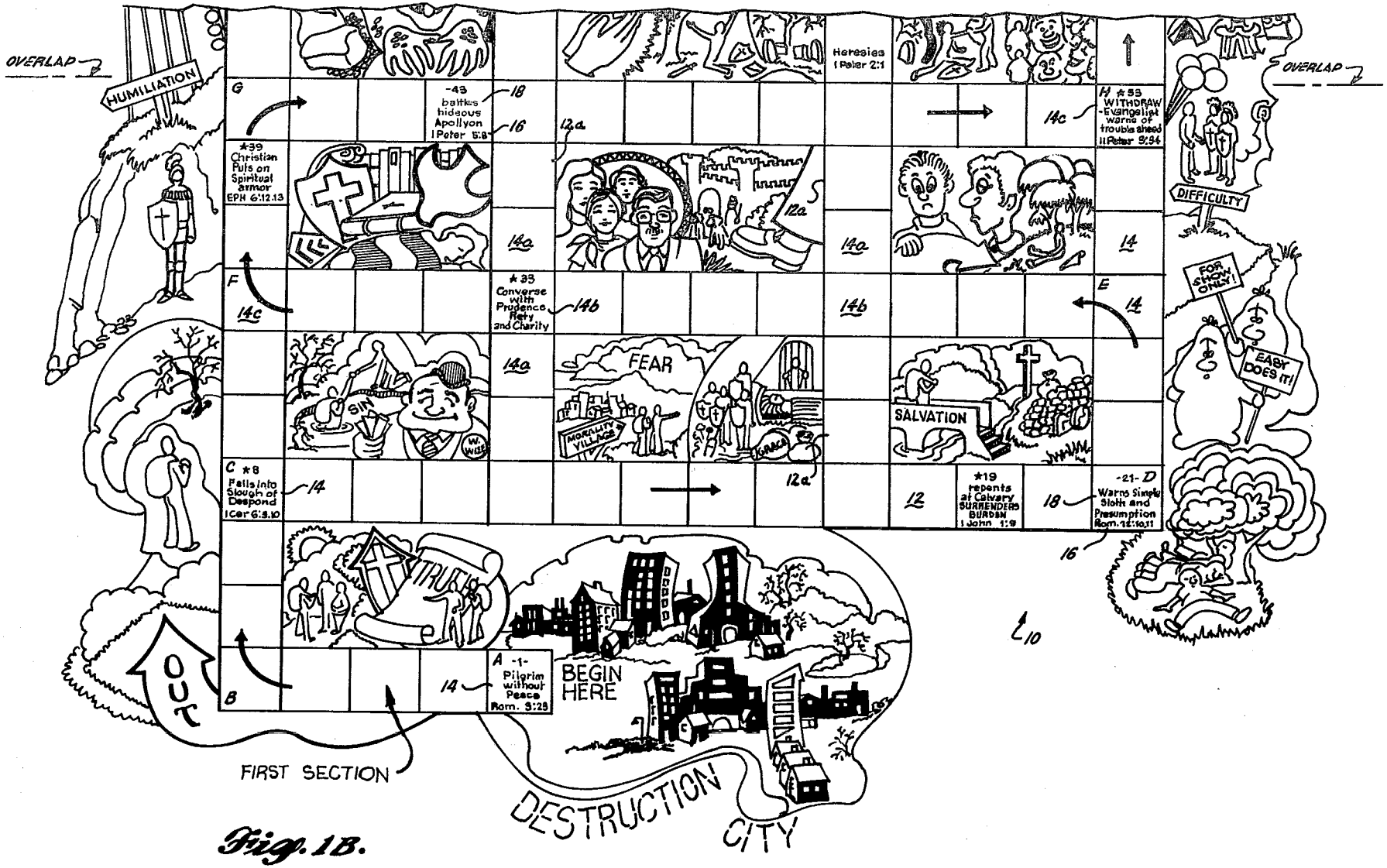

As can be seen in FIGS. 1A and 1B, which overlap at the point designated thereon, there is a game board 10 displaying on its playing surface a circuitous main path of travel 12, with the correct course of travel indicated by a dashed line and arrows. In addition there are a plurality of side paths **12*a* extending laterally from the main path 12. In the preferred embodiment, the game board paths 12 and 12*a*** are provided in a plurality of colors designating the correct course of travel as well as special locations described hereinafter.

The main path 12 is divided into ninety-two squares, with each square 14 being provided with a Biblical scripture notation 16 which may become relevant during the play of the game. There is also provided on most squares 14 short phrases 18 depicting an event during Pilgrim's journey, meant to reacquaint the participants with the significant events of *Pilgrim's Progress.* For ease of illustration, the writing on all ninety-two squares of the main path 12 has not been illustrated. Instead, pertinent squares indicating significant actions have been included to provide insight into the correct manner of play. The side paths 12*a* are also divided into squares 14*a*. The main path 12 has a beginning point designated "Destruction City" and an end point designated "Celestial City".

The main game board path 12 may be considered as divided into two sections corresponding to the Pilgrim's travel through life. The first section, comprising squares numbered 1' through 19', represents travel through life in an unenlightened condition before one has discarded the burdens of spiritual and moral poverty. The second section, comprising squares numbered 39' through 91', represents Pilgrim's travel through life after being offered and accepting the spiritual armor which will protect him for the rest of his journey to Celestial City. That portion of the main path 12 between squares 19' and 39', where Pilgrim has discarded his burden but not yet received the spiritual armor, may be considered a sort of spiritual or moral "limbo".

Even after Pilgrim has discarded the burden and received his spiritual armor, there are diversions which delay his arrival at Celestial City. On the game board 10, these are represented by junction squares, some of which are internal squares 14*b* (i.e. in the interior part of the path 12), as at square 33', and some of which are external squares 14*c* (i.e. on the exterior part of the path 12), as at square 53'. If a player's marker should come to rest on one of these squares 14*b* and 14*c*, additional play, as described hereinafter is required with a second chance means. Upon being diverted from the main course of travel, the player is confronted with one of a number of possible diversions, such as those associated with square number 65'. While these diversions, such as adultery, fornication, and idolatry are not necessarily experienced by Pilgrim in *Pilgrim's Progress,* it is thought that they are representative of diversions frequently experienced in one's life. Each of these diversion squares are provided with a Biblical scripture notation which may be utilized, as discussed later.

MARKERS AND SYMBOLIC ATTACHMENTS

As additional game components there are a plurality of markers 20, one provided for each game participant, each marker being a representation of a pilgrim along the path of life. Each marker 20 is provided with three detachable symbolic members which are attached to a related marker to represent a spiritual state at different locations along the path of the board 10. These symbolic members are a burden 22, a shield 24 and a crown 26. The burden 22 is in the shape of a sack to be carried over the shoulder and is affixed to the marker 20 at the beginning point A located on the first square 1' by means of a securing device, such as a pin 22*a*, which fits into a shoulder hole 22*b* on the marker 20. The burden 22 is symbolic of an unenlightened spiritual state and is removed when a player's marker 20 reaches square number 19'. The shield 24 is symbolic of a protective device to ward off evil influences and is affixed to the marker 20 at square 39' by means of a securing device 24*a* which fits into a hand hole 24*b* on the marker 20. The shield 24 is surrendered when the marker 20 arrives at Celestial City, and then the crown 26 is placed on the head of the marker 20 by means of a securing pin 26*a* which fits into a hole 26*b* on top of the head of the marker.

FIRST AND SECOND CHANCE MEANS

Progression of a marker 20 along the game board path 12 is determined in part by a first chance indicating means in the form of a spinner/compass 28. The spinner/compass 28 is composed of a dial face 30 which has two levels of play thereon, with a spinner 32 pivotally mounted at a point 33. There are two levels of play, an inner, less desirable level of play 34 corresponding to the first portion of Pilgrim's journey and utilized for play over the first portion of the game board path 12, and an outer more desirable level of play 36 corresponding to the second section of Pilgrim's journey and utilized for play over the second portion of the game board path 12.

The inner less desirable level of play 34 is divided into a plurality of adjacent numerical designations arranged in a circle around the center point 33, with some of the numerical designations 38*a* being positive designations permitting forward progression along the game path 12, and some numerical designations 38*b* being negative to require rearward movement along the game path 12. There are character traits associated with each of the adjacent numerical designations 38*a* and 38*b* of the inner level, corresponding to the morally unenlightened path of travel governed by this level, such as fearful, rebellious, and insecure.

The outer more desirable level of play 36 is similarly divided into a plurality of adjacent numerical designations 40, all of which are positive allowing only forward progression along the game path 12. There are character traits 41 associated with each of the numerical designations 40 corresponding to the more spiritually enlightened level of play on the outer level, such as love, faith and goodness. The outer level of play 36, coming into play after Pilgrim sheds his burden, allows a more rapid progression toward the destination, "Celestial City", and indicates the more rapid pace of Pilgrim's progress toward Celestial City after surrendering the burden 22 and acquiring the spiritual armor 24.

There are special designations on both the inner 34 and the outer 36 levels of play denoted as "Scripture Hunt" 42, in which the participant moves his marker 20 the designated number of spaces and then must locate and read in a Bible the scripture notations 16 contained on the square 14 upon which the marker 20 comes to rest.

The aforementioned spinner 32 has a shorter arm 32*a* which indicates a numerical designation on the inner level of play 34, with the shorter arm 32*a* being used for play over the first section of the path. The spinner 32 also has a longer arm 32*b* which indicates a numerical designation on the outer level of play 36, with the longer of the arms 32*b* being used for play over the second section of the path 12.

There are special locations on the spinner/compass dial face 30 which may require further action by a participant to complete a turn. As indicated previously, if the spinner arm 32*a* or 32*b* should come to rest upon a location denoted "Scripture Hunt" 42 on either the inner level 34 of play or the outer level 36 of play, the player is required to move his marker 20 the number of spaces noted by the spinner arm 32*a* or 31*b* and then locate and read in a Bible the scripture notation provided on that square 14. There is also provided on the inner level 34 of play one or more spaces bearing the notation "Repentant, GO to No. 19", this being indicated at 44. These squares allow an immediate advance to square number 19' from anywhere on squares 1'-18'.

The second chance means is in the form of a pair of dice 46 and is utilized when after spinning the spinner 32, a player's marker 20 comes to rest upon a junction square 14*b* or 14*c*, which requires further action before the turn is complete. Junction squares may be either a 'North-South' junction square 14*b* or a 'South-only' junction square 14*c*. 'South-only' junction squares 14*c* are identified as the junction of a horizontal portion of the game path 12 which intersects the next-ascending vertical portion of the game path 12 without main path squares 14 immediately therebelow. These 'South-only' junction squares are denoted by the letters F, H, J and L, as well as two additional squares K' and K" on the uppermost complete horizontal row of the game path 12. 'North-South' junction squares 14*b* are identified as those squares on a horizontal portion of the main path 12 which intersect a vertical row of side path squares 14*a*, such a junction point being an 'internal' junction while the 'South-only' junction squares are 'external' junctions. Play upon 'North-South' junction squares 14*b* may be either North (up) or South (down) while play on 'South-only' junction squares may be only South (down).

Upon landing either a North-South or a South-only junction square 14*b* or 14*c*, the player must roll the second chance means (i.e. a pair of dice 46) from the holding device 48 provided. One of the dice 50 has imprinted on its six sides the numerals "1", "2" and "3", with each numeral appearing twice (i.e. on two faces of the die 50). The other die 52 has imprinted upon its six faces the letters "N", "S" and "R", with each letter appearing twice (i.e. on two faces of the die 52).

If the player's marker 20 should come to rest upon a North-South junction square 14*b*, the player must roll both dice 46 to determine both the direction of the diversion off the main path 12, and the length of travel thereon. The lettered die 52 may read "N" or "S" in which case the player's marker is moved North (up) or South (down) upon the side-path 12*a* the number of spaces indicated. If the initial lettered die 52 should have the "R" face showing, this indicates that a scripture passage must be located and read. After rolling an "R" the player must immediately thereafter roll the lettered die 52 again to get an indication of direction, either North or South. The numbered die 50 indicates the length of travel after the direction is known, being either one, two or three spaces.

If the player's marker 20 should come to rest upon a South-only square 14*c*, the only possible direction for the diversion is South (down). Therefore the lettered die 52 is utilized only to indicate if scripture is to be located and read "R". If "N" or "S" is shown on the die, it is an indication that no scripture must be read. The roll of the numbered die 50 determines the length of the diversion; i.e. one, two or three spaces down.

As an example of play using the second chance means 46, if a player's marker 20 came to rest on square number 33' after spinning the spinner 32, square 33' being a 'North-South' junction square, the player would be required to roll both dice 46 in the holding device 48 in order to determine the direction and distance of the diversion. If "R" (read) and "3" were revealed, the player would roll the lettered die 52 again to determine the direction. If "S" (South) were then indicated, the player would move his marker 20 South (down) three spaces, and since "R" had been first indicated, the player would be required to locate and read ("R") the scripture passage indicated.

Upon the player's next turn, he would start from the position his marker 20 occupied after using the second chance means 46 on his previous turn, and move the number of spaces indicated on the spinner 32 by returning to the original junction square and then proceeding. If on the previous roll of the numbered die 52 either a "1" or a "2" was played, the player on his subsequent turn returns to the original junction square 14*b* and then proceeds on the main path 12 in a normal forward progression. But if, as in the example, a "3" were revealed and played, on his subsequent turn the player moves his marker 20 back to the original North-South junction square and then backward to complete the move if a number greater than "3" is shown on the spinner dial 28.

QUESTION AND ANSWER CARDS AND DISPLAY TOKENS

There is provided a second game component independent from the aforementioned first and second chance means comprising four sets of scripture playing cards 54, each consisting of correspondingly numbered sets of question cards 56 and answer cards 58. The question cards 56 are designated ∓Hearer" cards, and the answer cards are designated "Doer" cards. The question cards 56 and answer cards 58 are numbered on the front side sequentially, and the answer cards 58 have corresponding numerical designations on the back sides thereof.

Upon the playing face 60 of said question cards 56 there is a Biblical quotation 62 with a plurality of key words deleted therefrom to provide blank spaced 64 in the quotation. The quotation 62 is chosen so as to have some relevance to the story of *Pilgrim's Progress* and aid in the understanding thereof. At the bottom of the question card 56 there is a plurality of possible answer words 66 for inclusion in the spaces 64 where words have been deleted. Each possible answer word 66 has associated with it a numerical designation 67, the words 66 being numbered in sequence, such as 1 through 10. This numerical designation 67 provides the basis for scoring as described below.

As an example of a question card 56, the quotation may be provided in part thusly: "Nevertheless the ———— of God standeth ————, having this seal, the Lord knoweth them that are ————. And let everyone that ———— the name of Christ depart from iniquity." Possible answer words 66 provided may be numbered 1 through 10, and include "1. sure, 2. knowledge, 3. His, 4. temple, 5. foundation, 6. strong, 7. nameth, 8. called, 9. believes, 10. claims."

Upon the face of each correspondingly numbered answer card 58 is the identical Biblical quotation 62 but with the correct answers 68 provided where they had been deleted on the question card 56. Therefore the answer card 58 would read, "Nevertheless the FOUNDATION of God standeth SURE, having this seal, the Lord knoweth them that are HIS. And let everyone that NAMETH the name of Christ depart from iniquity." There is provided at the bottom of each answer card 58 the numerical designation of each correct answer word 68 and a total score if all were answered correctly, this being indicated at 69. In the example above, the correct answer words being numbered "5, 1, 3, and 7" the total score for this card would be 16 points.

To indicate the answer words 66 selected, each player is provided with a plurality of numbered answer tokens 70 corresponding in number to the greatest possible number of correct answer words 65, and a display rack 72 for displaying same. As the participant reads the question card, he selects numbered tokens 70 to correspond to the numbers of the words selected. These selected tokens are then placed on the rack 72 designed to hold same and to indicate the selected answers. For example, if the participant were to select correctly the answer words of the preceding paragraph, he would display on his rack 72 four tokens 70, bearing the numerals "5", "1", "3" and "7". A tally chart 74 is provided for entering the score of each participant as it is earned and allows a running total to be kept.

OTHER COMPONENTS

A Bible, such as the King James Version, is used at various times for "Scripture Hunts". A timer 76 in the form of a simple hour-glass is provided, within which time each player's complete move must be completed. Card holders 78 are provided to hold each player's question cards 56. An instruction booklet 80 is also provided.

PLAYING THE GAME

The applicant believes that a clearer understanding of the game and its components may be possible by a detailed description of how the game is played in the preferred embodiment. To begin the game, two sets of question 56 and answer 58 cards are selected, the players dividing equally between themselves and question (Hearer) cards 56 and placing the randomly arranged correspondingly numbered answer card 58 face down on the game board 10. The order of play is determined by the order of appearance of the randomly arranged numbered answer cards 58, with the turn being taken by the player who has the numbered question card 56 corresponding to the numbered answer card 58 appearing on the top of the deck.

The player silently reads the Biblical scripture 62 imprinted on his question card 56 and attempts to determine the deleted key words 68 indicated by blanks 64 using the numbered list of possible answer words 66 provided therebelow. The player then selects numbered tokens 70 corresponding in number to the numbered words 66 chosen, and places the selected tokens 70 in the rack 72 in appropriately order. The answer card 58 is then turned over and the entire answer, including the correct answer words 68, is read aloud and checked against the answers selected by the player as revealed by his displayed numbered tokens 70. Points are awarded for correct answers selected, based upon the numerical designation of each correctly selected answer word 68. For example, if there are on the question card 56 four blanks 64, and from a numbered list of ten possible answer words 66 provided therebelow, the correct answers are those numbered "5, 1, 3 and 7", then the maximum total score for supplying all correct answers would be 16, as shown at 69. If the player supplied the first, second and fourth answer words 68 correctly, but supplied an incorrect answer for the third deleted word, then the total score would be 13. The correct score is entered on the tally chart 74 for each participant.

After a player completes that portion of his turn with the scripture cards 54, he then proceeds to the second phase of his turn with play upon the game board 10. For ease of illustration the wording on only some of the ninety-two squares 14 along the main path 12 have been illustrated. Each player places his marker 20, representing his particular "Pilgrim", on the beginning square 14, representing Destruction City, and affixes a burden 22 on his marker 20. Utilizing the first chance means 28, the player manually spins the spinner 32 pivotally mounted at 33. Since Pilgrim first starts his journey from Destruction City weighted down by his burden 22, the marker 20 must progress on the main path 12 in the less spiritually enlightened state indicated by the inner level 34 of the spinner compass 28. The player follows the indication of the shorter spinner arm 32*a* until passing square number 19′ at which time he then begins using the longer spinner arm 32*b*.

In moving through the first portion of the path 12 (i.e. squares numbered 1′ through 19′), the player's marker 20 is moved the number of spaces (squares) indicated by the inner spinner arm 32*a* on the inner level 34. Since the inner level of adjacent numerical values contains both positive 38*a* and negative 38*b* values, the marker 20 is not moved rearward as indicated by a negative value 38*b* until it has progressed beyond the beginning point at Destruction City. The inner level 34 of play, having negative numerical values 38*b*, corresponds to the slow pace of the Pilgrim's journey in his unenlightened condition, actually regressing at some points during his trip. The marker 20 progresses along the main path 12 in the manner indicated by the arrows and the sequence of letters A–N.

When the spinner arm 32*a* stops at the special inner level spinner notation of "Repentent" 44, the marker 20 is immediately moved to square 19′, and is permitted to continue play thereafter according to the long spinner arm 32*b*. A player's marker 20 may not proceed past square 19′ until the "Repentent" 44 notation has been spun by that participant. If the spinner arm 32*a* should come to rest upon an inner level location marked "Scripture Hunt" 42, the player moves his marker 20 to the indicated number of spaces and then must locate and read the biblical scripture 16 noted within the time limit provided by the timer 76.

At square 19′ Pilgrim, as represented by the marker 20, sheds the burden 22, having become a Christian. He then must travel a path unhindered by his burden 22, but not yet fully protected by his spiritual commitment (i.e. the shield 24). At square number 39′, Pilgrim and the marker 20 receive the spiritual armor represented by the shield 24 necessary to protect him throughout the remainder of his journey.

After passing beyond square 19′, further play of that marker 20 is according to the indication of the outer spinner arm 32*b* on the outer level of play 36 corresponding to the more enlightened condition after shedding the burden and becoming a Christian. The player's marker 20 may then come to rest upon a junction square 14*b* or 14*c*, indicating a diversion from the main path 12 and a challenge to Pilgrim's faith. Further play with the second chance means 46 is required to complete the turn.

If the junction square is an internal North-South junction square 14*b*, the player must roll both the numbered 50 and the letter 52 die. The lettered die 52 determines the direction of diversion from the junction square 14*b*, either North (up) or South (down), with the length of diversion indicated on the numbered die 50, either "1, 2, or 3". If the lettered die 52 indicates an "R" on the first roll, it must be re-rolled until a direction either North (N) or South (S) is indicated. If "R" was the first letter designation, the marker 20 is moved to the space indicated by the dice 46 and the biblical scripture indicated on that square must be found and read from the Bible to complete the turn. There is no biblical reading associated with junction square diversions unless "R" is the first-indicated result of the lettered die 52. If the marker 20 comes to rest on a South-only junction square 14c, the numbered die 50 is rolled as usual, however the lettered die 52 is rolled only to determine if scripture must be read to determine direction since South (down) is the only direction possible.

If on an internal North-South junction square 14b the numbered die 50 indicates a "3", it is considered a penalty and rearward movement is required of the marker 20 upon return to the original junction square. Therefore if after rolling a "3" on the numbered die 50 the player on his next turn spins a "5" on the spinner arm 32b, he advances the three spaces back to the original junction square 14b and completes his turn by moving the marker 20 two spaces rearward from the original junction square 14b.

There may also be a number of squares 14 upon the main path 12 which cause the marker 20 to be delayed along the path 12 instead of advancing, such as directions causing a rearward movement to a particular square 14 or a particular number of squares 14 rearward. Delays may also result from skipping a turn with the spinner 32 or being required to move to a junction square 14b or 14c. While these instructions are not printed on the game board 10 or path 12, they are contained in the instruction booklet 80.

There may be one or two winners to this game. One winner is the first participant to successfully move his marker 20 over the course of the game board path 12 to the destination of Celestial City, surrending the shield 24 and accepting the crown 26. This can be accomplished either by progressing over all squares 14 to the end point, or by landing on square number 58' allowing an immediate and direct ascension to Celestial City. When one marker 20 reaches Celestial City, the game ends. At that point the player with the highest number of scripture points on the tally chart 74, resulting from correctly selecting words for the blanks 64 on the question cards 56, is also a winner. Therefore, if the first player to reach Celestial City is also the player with the highest scripture score, there is one winner. Otherwise there are two.

Thus, it can be appreciated that in the playing of this game there is an element of chance since each player's progress is at least partly determined by the spin of the spinner 32 or the roll of the dice 46. On the other hand, there may be a completely independent winner based solely upon a knowledge of the Bible as it relates to the novel *Pilgrim's Progress*. The combination of these, plus the inclusion of the literary aspects of the religious classic *Pilgrim's Progress in a new game format add an element of excitement and provide an easy and interesting method of becoming familiar with the text and teaching of both the Bible and Pilgrim's Progress.*

What is claimed is:

1. A game apparatus to correlate game play to the story and events of "Pilgrim's Progress" and to familiarize the participants with the literary, moral and spiritual values of "Pilgrims's Progress", said game apparatus comprising:

a. a gameboard displaying a path having a beginning location, an end location, and an intermediate location, and having representations thereon simulating the path followed by Pilgrim, said path being separated into increments of travel and having a first section extending from said beginning location to said intermediate location and having representations thereon indicating Pilgrim's travel through life in an unenlightened moral state and a second section extending from said intermediate location to said end location, having representations thereon indicating Pilgrim's travel through life in a more enlightened moral state, said first section and said second section being connected in series, and b. first chance means in the form of a first concentric circle corresponding to said first path section and presenting randomly determined positive and negative numerical values determining the player's progress along said path, said postive numerical values indicating Pilgrim's forward travel along said path and negative numerical values regressive movement along said path, said first chance means having representations of specific moral traits associated with numerical values, such that less desirable moral traits are associated with numerical values of a lower magnitude, and more desirable character traits are associated with numerical values of a greater magnitude.

c. second chance means in the form of a second circle, concentric with said first circle, presenting the randomly determined numerical values determining the player's progress along said path, said second chance means producing numerical results of higher value corresponding to Pilgrim's travel along said second path section of travel in greater moral enlightenment, said second chance means being adapted for use only after a participant has progressed from said first section of said path d. said game apparatus further having markers representing a Pilgrim as in *Pilgrim's Progress*, for use by game participants to indicate locations on said game path, and there is a first symbolic member in the shape of a burden to be attached to at least one of said markers at the beginning of said first path section and removed upon leaving said first path section, and there is a second symbolic member in the shape of a protective device, to be attached to at least one of said markers at the beginning of said second path section, and e. said game apparatus further having:

1. a plurality of question cards containing Biblical quotations relevant to the story of *Pilgrim'Progress*, with key words deleted therefrom, and a number of possible correct answer words associated therewith, with said answer words having identifying designations,
2. a plurality of answer cards identified to correspond to related question cards and having numerically identified answers thereon corresponding to at least one of said answer words to indicate the correct words to be inserted in said quotations, and
3. display means having designation in the form of numerical designations of different value corresponding to the numerical designations of each of the possible answer words whereby game participants are able to display selections of answer words relevant to *Pilgrim's Progress* prior to determining the correct answers from the answer cards.

whereby when the chance means is operated during game play to indicate Pilgrim's progress along the path of life, there is a probability of greater progress in travel along the second path section which indicates a more enlightened state than in travel along the first path section which indicates a less enlightened state.

2. A game apparatus simulating travel on a path through life leading to spiritual and moral fulfillment, said game apparatus comprising:

a. a game board displaying a path, said path being separated into increments of travel squares and having a first section having representations thereon indicating travel through life in an unenlightened moral state and a second section having representations thereon indicating travel through life in a more enlightened moral state, and b. a chance means presenting randomly determined numerical values determining the player's progress along said path, said chance means having a first part producing numerical results of lower value corresponding to travel along said first path section of travel in lesser moral enlightenment, and having a second part producing numerical results of higher value corresponding to travel along said second path section of travel in greater moral enlightenment, whereby when the chance means is operated during game play to indicate progress along the path of life, there is probability of greater progress in travel along the second path section which indicates a more enlightened state than in travel along the first path section which indicates a less enlightened state, said game being further characterized in that there are complementary sets of question and answer indicating means, and means to indicate when game participants are to select a question indicating means to answer a question indicated thereon, with a corresponding answer indicating means indicating the answer, said question and answer indicating means comprising:

a. a plurality of question cards containing quotations, with key words deleted therefrom, and a larger number of possible correct answer words associated therewith, with said answer words having identifying designations, b. a plurality of answer cards identified to correspond to related question cards and having numerically identified answers thereon corresponding to at least one of said answer words to indicate the correct words to be inserted in said quotations, and c. display means having designations in the form of numerical designations of different value corresponding to the numerical designations of each of the possible answer words whereby game participants are able to display selections of answer words prior to determining the correct answers from the answer cards.

3. The game apparatus as described in claim 2 wherein said possible correct answers associated with said question card have numerical values associated therewith, such that upon choosing answer words, participants are able to receive as an achievement a value of points associated with the numerical values of the correctly selected answer words.

4. The game apparatus as receited in claim 2, wherein said display means comprises a plurality of tokens having designations thereon corresponding to those of said answer words, and means to mount said tokens in a sequence corresponding to the occurence of the selected answer words in the corresponding quotation on the question card.

5. The game apparatus as recited in claim 4, wherein said designations for the answer words are numerical disignations of different values, whereby participants are able to receive as an achievement a value of points associated with the numerical values of the correctly selected answer words.

6. A game apparatus to correlate game play to the story and events of "Pilgrim's Progress" and to familiarize the participants with the literary, moral and spiritual values of "Pilgrim's Progress", said game apparatus comprising:

a. a gameboard displaying a path, having representations thereon simulating the path followed by "Pilgrim" in "Pilgrim's Progress", said path being separated into increments of travel and having a first section having representations thereon indicating Pilgrim's travel through life in an unenlightened moral state and a second section having representations thereon indicating Pilgrim's travel through life in a more enlightened moral state, and b. a chance means presenting randomly determined numerical values determining a player's progress along said path, said chance means having a first part producing numerical results of lower value corresponding to Pilgrim's travel along said first path section of travel in a state of lesser moral enlightenment and having a second part producing numerical results of higher value corresponding to Pilgrim's travel along said second path section of travel in a state of greater moral enlightenment, whereby the chance means is operated during game play to indicate Pilgrim's progress along the path of life, there is a probability of greater progress in travel along the second path section which indicates a more enlightened state than in travel along the first path section which indicates a less enlightened state, said game being further characterized in that there are complementary sets of question and answer indicating means and means to indicate when game participants are to select a question indicating means to answer a question indicated thereon, with a corresponding answer indicating means indicating the answer, said question and answer indicating means comprising:

a. a plurality of question cards containing quotations relevant to the story of "Pilgrim's Progress" with key words deleted therefrom, and a larger number of possible correct answer words associated therewith, with said answer words having identifying designations, b. a plurality of answer cards identified to correspond to related question cards and having numerically identified answers thereon corresponding to at least one of said answer words to indicate the correct words to be inserted in said quotations, and c. display means having designations in the form of numerical designations of different value corresponding to the numerical designations of each of the possible answer words, whereby game participants are able to display selections of answer words prior to determining the correct answers from the answer cards.

7. The game apparatus as described in claim 6, wherein said possible correct answers associated with said question card have numerical values associated therewith, such that upon choosing answer words, participants are able to receive as an achievement a value of points associated with the numerical values of the correctly selected answer words.

8. The game apparatus as recited in claim 6, wherein said display means comprises a plurality of tokens having designations thereon corresponding to those of said answer words, and means to mount said token in a sequence corresponding to the occurrence of the selected answer words in the corresponding quotation on the question card.

9. The game apparatus as recited in claim 8, wherein said designations for the answer words are numerical designations of different values, whereby participants are able to receive as an achievement a value of points associated with the numerical values of the correctly selected answer words.

10. A game apparatus comprising:

a. a game board displaying a path separated into increments of travel along said path, b. chance means presenting randomly determined numerical values determining a player's progress along the path, c. a plurality of question cards containing quotations, with key words deleted therefrom, and a larger number of possible correct answer words associated therewith, with said answer words having identifying designations, d. a plurality of answer cards identified to correspond to related question cards and having numerically identified answers thereon corresponding to at least one of said answer words to indicate the correct words to be inserted in said quotations, e. means to indicate when game participants are to select a question card, and f. display means having designations in the form of numerical designations of different value corresponding to numerical designations of each of the possible answer words, whereby game participants are able to display selections of answer words prior to determining the correct answers from the answer cards.

11. The game apparatus as recited in claim 10, wherein said display means comprises a plurality of tokens having designations thereon corresponding to those of said answer words, and means to mount said tokens in a sequence corresponding to the occurrence of the selected answer words in the corresponding quotation on the question card.

12. The game apparatus as recited in claim 10, wherein said designations for the answer words are numerical designations of different values, whereby participants are able to receive as an achievement a value of points associated with the numerical values of the correctly selected answer words.

13. A game apparatus simulating travel on a path through life leading to spiritual and moral fulfillment, said game apparatus comprising:

a. a game board displaying a path, separated into increments of travel, and having a first section having representations thereon indicating travel through life in an unenlightened moral state and a second section having representations thereon indicating travel through life in a more enlightened moral state, and b. first chance means in the form of a first concentric circle having positive and negative numerical values, corresponding to travel on said first path section, with positive numerical values indicating forward travel along said path and negative numerical values causing regressive movement along said path, said first chance means further having representations of specific character traits associated with the numerical values indicating varying degrees of desirability, such that less desirable moral traits are associated with numerical values of a lower magnitude, and more desirable character traits are associated with numerical values of a greater magnitude, and second chance means in the form of a second concentric circle having representations thereon of more desirable character traits associated with numerical values of greater magnitude corresponding to travel on said second path section, whereby in game play there is provided a reenactment that adherence to more desirable moral values is more likely to lead to progress along the path of life, c. said game apparatus further having markers representing people on the path of life, for use by game participants to indicate locations on said game path, and there is a first symbolic member in the shape of a burden, to be attached to at least one of said markers at the beginning of said first path section and removed upon leaving said first path section, and there is a second symbolic member in the shape of a protective device to be attached to at least one of said markers at the beginning of said second path section, and d. said game apparatus further having:

1. a plurality of question cards containing Biblical quotations with key words deleted therefrom, and a number of possible correct answers associated therewith, with said answer words having identifying designations in the form of numerical designations of different value, 2. a plurality of answer cards identified to correspond to related question cards and having answers thereon to indicate the correct words to be inserted in said quotations, and 3. display means having identifying designations for the correct answer words as numerical designations of different numerical value, said display means comprising tokens presenting such numerical values, and means to mount said tokens in a desired sequence corresponding to selection of said answer words, with the selection of the answer words by the participant not only identifying the selected answer words, but also enabling participants to receive as an achievement a value of points associated with the numerical values of the correctly selected answer words.

14. A game apparatus to correlate game play to the story and events of *Pilgrim's Progress* and to familiarize the participants with the literary, moral and spiritual values of *Pilgrim's Progress*, said game apparatus comprising:

a. a game board displaying a path having representations thereon simulating the path followed by Pilgrim, said path being separated into increments of travel and having a first section having representations thereon indicating Pilgrim's travel through life in an unenlightened moral state and a second section having representations thereon indicating Pilgrim's travel through life in a more enlightened moral state, and b. first chance means having positive and negative numerical values, corresponding to Pilgrim's travel on said first path section, with positive numerical values indicating forward travel along said path and negative numerical values causing regressive movement along said path, said first chance means further having representations of specific character traits associated with the numerical values indicating varying degrees of desirability, such that less desirable moral traits are associated with numerical values of a lower magnitude, and more desirable character traits are associated with numerical values of a greater magnitude, and second chance means having representations thereon of more desirable character traits associated with numerical values of greater magnitude corresponding to travel on said second path section, whereby in game play there is provided a reenactment that adherence to more desirable moral values is more likely to lead to progress along the path of life, c. said game apparatus further having markers representing Pilgrim on the path of life, for use by game participants to indicate locations on said game path, and there is a first symbolic member in the shape of a burden, to be attached to at least one of said markers at the beginning of said first path section and removed upon leaving said first path section, and there is a second symbolic member in the shape of a protective device to be attached to at least one of said markers at the beginning of said second path section, and d. said game apparatus further having:

1. a plurality of question cards containing Biblical quotations with key words deleted therefrom, and a number of possible correct answers associated therewith, with said answer words having identifying designations in the form of numerical designations of different value,
2. a plurality of answer cards identified to correspond to related question cards and having answers thereon to indicate the correct words to be inserted in said quotations, and
3. display means having identifying designations for the correct answer words as numerical designations of different numerical value, said display means comprising tokens presenting such numerical values, and means to mount said tokens in a desired sequence corresponding to selection of said answer words, with the selection of the answer words by the participant not only identifying the selected answer words, but also enabling participants to receive as an achievement a value of points associated with the numerical values of the correctly selected answer words.

* * * * *